US005791137A

United States Patent [19]

Evans et al.

[11] Patent Number: 5,791,137

[45] Date of Patent: Aug. 11, 1998

[54] RADIAL INFLOW DUAL FUEL INJECTOR

[75] Inventors: Tyler T. Evans, Palms Beach Gardens; Robert G. Carroll, West Palm Beach, both of Fla.

[73] Assignee: United Technologies Corporation, Hartford, Conn.

[21] Appl. No.: 556,316

[22] Filed: Nov. 13, 1995

[51] Int. Cl.[6] ..... F23R 3/36

[52] U.S. Cl. ..... 60/39.463; 60/737

[58] Field of Search ..... 60/39.463, 737, 60/738, 746, 747

[56] References Cited

U.S. PATENT DOCUMENTS

| | | | |
|---|---|---|---|
| 4,215,535 | 8/1980 | Lewis | 60/736 |
| 4,222,232 | 9/1980 | Robinson | 60/737 |
| 4,226,083 | 10/1980 | Lewis et al. | 60/39.06 |
| 4,253,301 | 3/1981 | Vogt et al. | 60/39.463 |
| 4,262,482 | 4/1981 | Roffe et al. | 60/39.463 |
| 5,408,825 | 4/1995 | Foss et al. | 60/39.463 |
| 5,511,375 | 4/1996 | Joshi et al. | 60/737 |

*Primary Examiner*—Louis J. Casaregola
*Attorney, Agent, or Firm*—Marina F. Cunningham

[57] ABSTRACT

A gas turbine engine combustor can operate on either liquid fuel or gaseous fuel while maintaining low levels of nitrous oxide emissions. An upstream end of each of a plurality of mixing tubes includes an external manifold that is supplied with gaseous fuel. The gaseous fuel is injected into the mixing tubes through a plurality of orifices with sufficient momentum to be uniformly distributed across the flow path of each mixing tube. The optimum fuel/air ratio for low nitrous oxide emissions does not exceed seventy five percent (75%) of the stoichiometric ratio for a given fuel.

5 Claims, 4 Drawing Sheets

RADIAL INFLOW DUAL FUEL INJECTOR

TECHNICAL FIELD

This invention relates to combustors for gas turbine engines and, more particularly, to combustors operating on either liquid fuel or gaseous fuel with low nitrous oxide emissions.

BACKGROUND ART

As a byproduct of combustion, gas turbine engines typically emit nitrous oxides ($NO_x$) that are harmful to the atmosphere. Formation of nitrous oxides during the combustion process generally results from a reaction between fuel and air at high temperatures. The level of nitrous oxide emissions can be reduced by controlling the temperature during the combustion process. A known approach to control the combustion temperatures and therefore to minimize the nitrous oxide emissions is to ensure complete combustion of the fuel and to achieve uniform mixing of fuel and air.

U.S. Pat. Nos. 4,222,232 to Robinson, 4,226,083 to Lewis et al, and 4,215,535 to Lewis teach an effective method and apparatus for reducing nitrous oxide emissions from gas turbine engines that operate on liquid fuel by ensuring complete combustion of the fuel and by achieving uniform mixing of fuel and air. The configuration described in the above-mentioned patents is very sensitive to any variations therein. It is the precise system described in those patents that results in low nitrous oxide emissions. However, with fluctuating fuel prices, it is desirable for many customers with power generation needs to have the choice of operating gas turbine engines on either liquid fuel or gaseous fuel. Although a number of dual fuel nozzles are commercially available, none yield low nitrous oxide emissions with the configuration described in the U.S. patents mentioned above. Also, gas turbine engines operating on gaseous fuel must compensate for the variations in natural gas fuel temperature and pressure that are site specific. Most of the existing dual fuel nozzles cannot be adjusted easily to accommodate for variations in gaseous fuel while producing low nitrous oxide emissions. Thus, there is a great need in the industry to offer power generation customers a choice to operate on either liquid fuel or gaseous fuel while maintaining an acceptably low level of nitrous oxide emissions.

DISCLOSURE OF THE INVENTION

It is an object of the present invention to minimize nitrous oxide emissions in combustors operating on either liquid fuel or gaseous fuel.

It is another object of the present invention to add gaseous fuel capability to a liquid fuel only combustor, already yielding an acceptable nitrous oxide emissions level, without negatively impacting the level of those emissions.

According to the present invention, a gaseous fuel injection capability is implemented on an existing combustion system that yields low nitrous oxide emissions. An annular, external manifold is fixedly mounted at an upstream end of each of a plurality of mixing tubes so that gaseous fuel is supplied to the manifold and then injected into each of the plurality of mixing tubes through a plurality of gas orifices with sufficient momentum to be uniformly distributed across the flow path of the mixing tube. The orifices are formed within the mixing tube in a substantially perpendicular relationship to the mixing tube wall so that the maximum penetration for a given momentum is generated. The injected gaseous fuel is uniformly distributed across the flow path and is thoroughly mixed at the downstream end of each mixing tube as the fuel/air mixture enters the combustor. The optimum fuel/air ratio for low nitrous oxide emissions is approximately fifty to seventy five percent (50–75%) of the stoichiometric ratio for the primary mixing tubes and for the secondary mixing tube for each gaseous fuel and liquid fuel.

One primary advantage of the present invention is that the addition of the gaseous fuel capability does not interfere with the liquid fuel flow path and does not negatively impact the nitrous oxide emission while the gas turbine engine operates on liquid fuel.

The foregoing and other objects and advantages of the present invention become more apparent in light of the following detailed description of the exemplary embodiment thereof, as illustrated in the accompanying drawings.

BEST MODE FOR CARRYING OUT THE INVENTION

Figure 1:
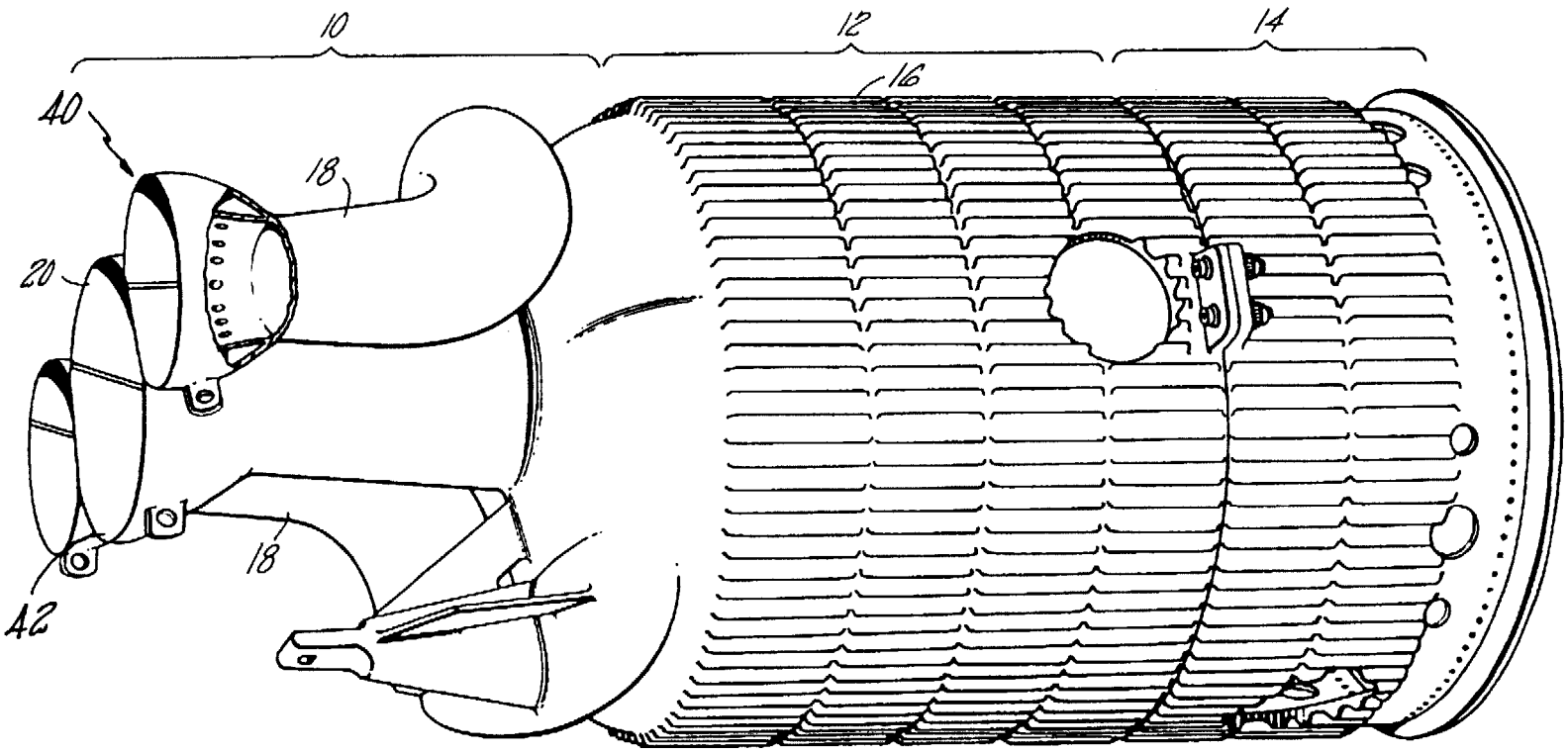
FIG. 1 is a simplified external perspective view of a combustor with a secondary mixing tube and a plurality of primary mixing tubes.

Referring to FIG. 1, a can-type combustion chamber, or combustor, is of the same type as described in U. S. Pat. Nos. 4,226,083 to Lewis et al, 4,215,535 to Lewis, and 4,222,232 to Robinson, the specifications of which are incorporated by reference herein. The combustor includes a fuel/air mixing zone 10, a combustion zone 12, and a dilution zone 14. The combustion zone 12 is formed by a cylindrical body 16. The fuel/air mixing zone 10 includes a plurality of primary, or pilot mixing tubes 18 and a single secondary, or main mixing tube 20. Each of the primary mixing tubes 18 has a serpentine geometry. The secondary mixing tube 20 is axially oriented with respect to the combustion chamber and is positioned near, but not necessarily coincident with, the axis of the combustion chamber.

Figure 2:
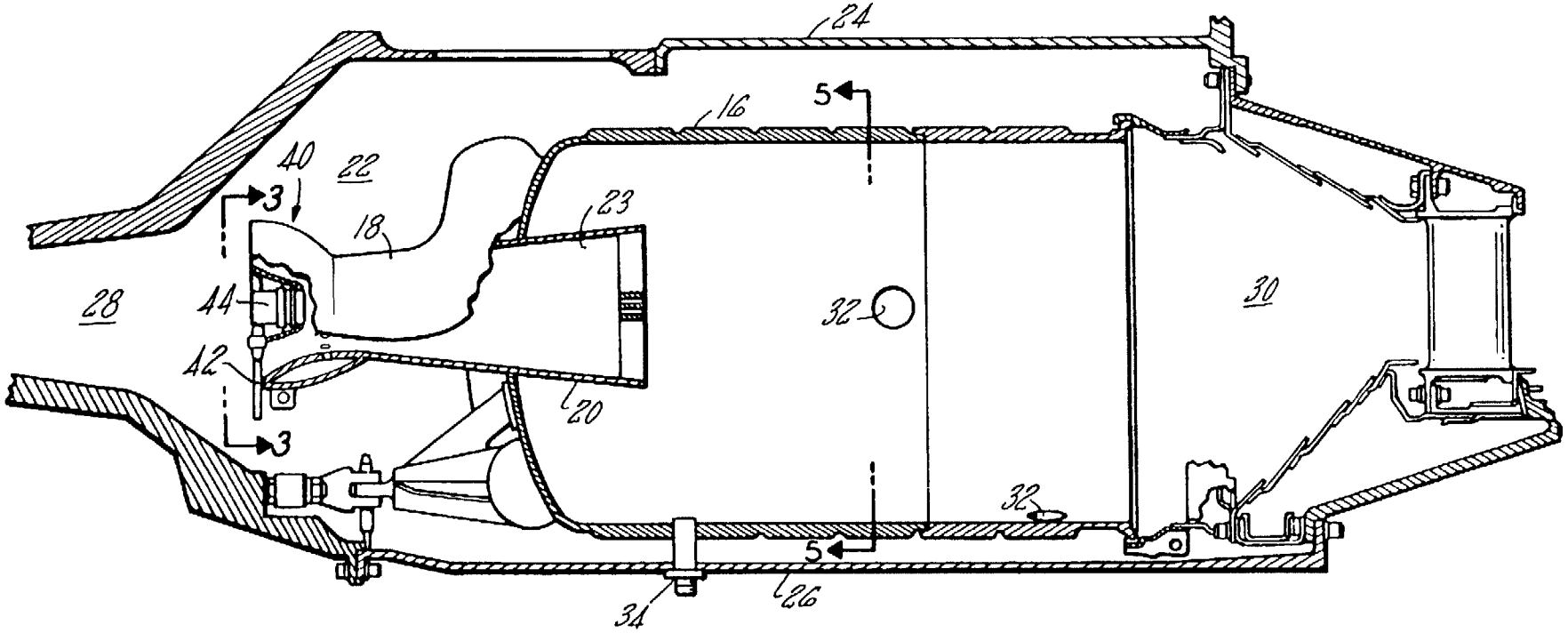
FIG. 2 is a simplified, partially broken-away, cross-section view of the combustor of FIG. 1 as installed in an engine.

Although a single combustor is shown, it is anticipated that a plurality of combustors will be employed in each engine. Referring to FIG. 2, the combustors are circumferentially spaced about the engine in an annulus 22 between an inner engine case 24 and an outer engine case 26. A diffuser 28 leads axially into the annulus 22 from a compression section (not shown). Each combustor discharges through a transition duct 30 to a turbine section (not shown). Dilution air is flowable into the dilution zone of the combustor through the dilution holes 32. An ignitor 34 penetrates the combustor in the region of discharge of the fuel/air mixture from the primary tubes 18.

Figure 3:
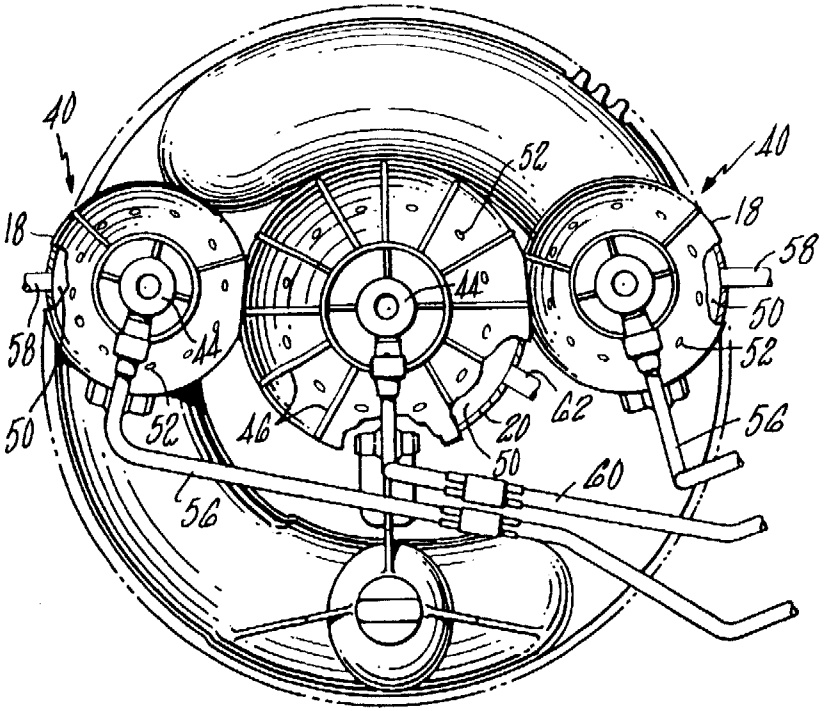
FIG. 3 is a front view of the combustor illustrated in FIG. 1.
Figure 4:
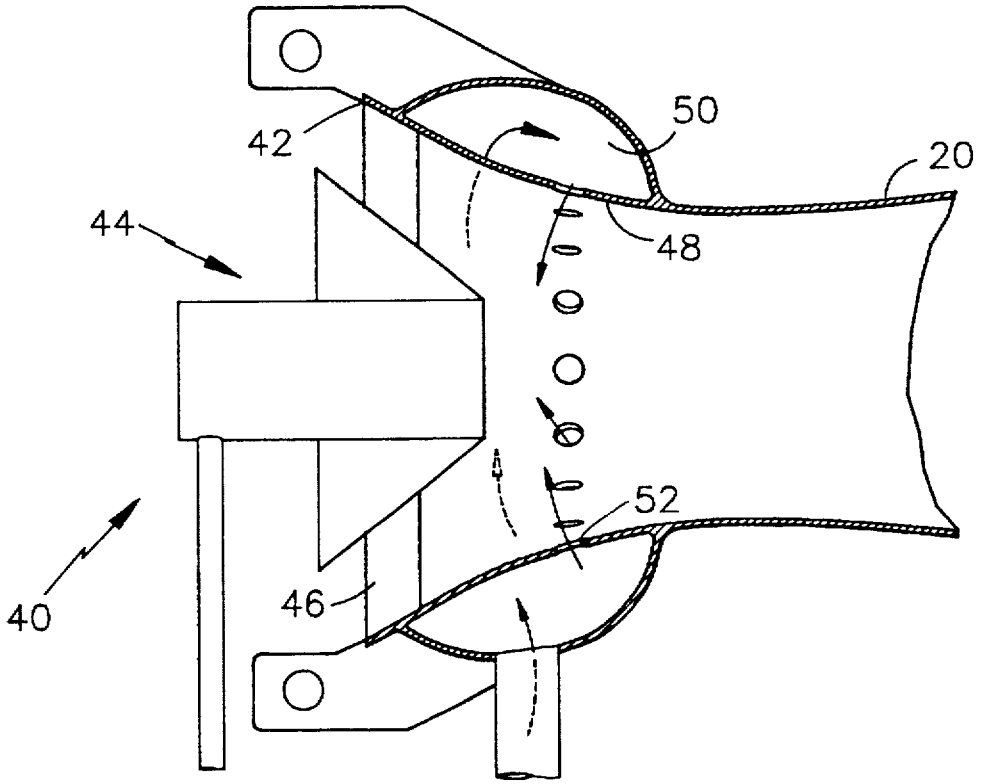
FIG. 4 is a simplified cross-section view of a venturi premixer of the secondary mixing tube of FIG. 1.

Referring to FIGS. 2–4, each primary tube 18 and the secondary tube 20 include a venturi fuel/air premixer 40 at an upstream end 42 thereof. An airblast liquid fuel nozzle 44 is centrally mounted within each venturi premixer 40. The secondary tube 20 also includes a plurality of inlet swirl vanes 46 that are mounted radially outward of the air blast liquid nozzle 44 and radially inward of a venturi premixer wall 48 of the venturi premixer 40, as can be seen in FIG. 4. An annular, external gaseous fuel manifold 50 is disposed radially outward from the venturi premixer wall 48 of each primary tube 18 and of the secondary tube 20. A plurality of gas orifices 52 are formed within the venturi premixer wall 48 of each tube 18, 20. The gas orifices 52 are formed in a substantially perpendicular relationship to the venturi premixer wall 48 and are equally spaced from each other in the circumferential direction. Although it is desirable to locate the gas orifices as far upstream as possible for optimum mixing, the orifices must be disposed sufficiently downstream so they do not impinge on the inlet swirl vanes 46 of the secondary tube 20. The shape of the gas orifices 52 is shown to be circular. However, other shapes such as slots or slits are acceptable.

Referring to FIG. 3, a liquid fuel supply means 56 supply liquid fuel to the airblast liquid fuel nozzle 44 of each primary tube 18. A gaseous fuel supply means 58 supply gaseous fuel to the manifold 50 of each of the primary tube 18. A liquid fuel supply means 60 and gaseous fuel supply means 62 supply liquid and gaseous fuel, respectively, to the airblast liquid fuel nozzle 44 and the manifold 50 of the secondary tube 20, respectively. The primary liquid fuel supply means 56 and the secondary liquid fuel supply means 60 are independently operable so as to enable staging of the liquid fuel flow to the combustor. The primary gaseous fuel supply means 58 and the secondary gaseous fuel supply means 62 are independently operable so as to enable staging of the gaseous fuel flow to the combustor.

Figure 5:
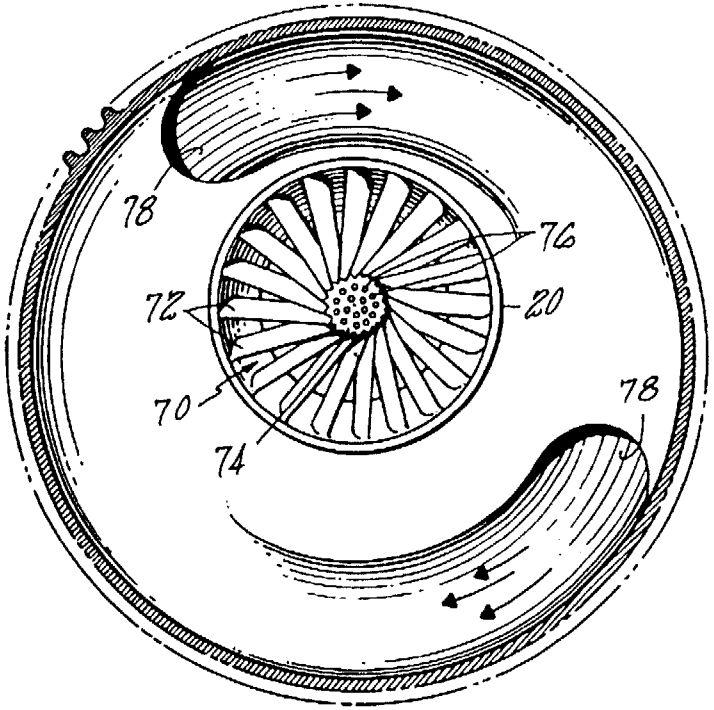
FIG. 5 is a cross-section view taken through the combustor in the direction 5—5 as shown in FIG. 2.

Each of the primary tubes 18 is adapted to discharge the gases flowing therethrough circumferentially into the radially outward portion of the combustion zone of the combustor. The secondary tube 20 is adapted to discharge the gases flowing therethrough into the central portion of the combustion zone. Referring to FIG. 5, the downstream end of the secondary tube 20 has an exit swirler 70 disposed thereacross. The swirler 70 is comprised of a plurality of exit vanes 72 for imparting a circumferential swirl to the medium gases flowing through the secondary mixing tube 20. A central plug 74 having a plurality of holes 76 disposed therein is positioned at the center of the mixing tube 20. Each of the primary or pilot mixing tubes 18 (not shown) discharges into the combustion chamber through a corresponding aperture 78. Flow discharged through the apertures 78 of the primary mixing tubes 18 is caused to swirl circumferentially about the chamber in a direction opposite to that at which the gases are discharged from the secondary mixing tube 20.

During operation of the combustor on liquid fuel, the operation of the combustor remains substantially the same as was described in the abovementioned U.S. patents. Thus, the phenomena described therein remains unaffected by the addition of the gaseous fuel capability.

During operation of the combustor on gaseous fuel, gaseous fuel is flowed through the gaseous fuel supply means 58 to the respective manifolds 50 of the primary tubes 18. The gaseous fuel is radially injected into the flow path through the gas orifices 52 with sufficient momentum to be distributed across the flow path of the primary mixing tubes 18. The combustor air enters the venturi premixer 40 substantially perpendicular to the gas jets so that the gas obtains maximum penetration for a given momentum. The gaseous fuel mixes with air in the primary tubes 18 in a ratio which is within the range of approximately fifty to seventy-five percent (50–75%) of the stoichiometric ratio for the gaseous fuel employed.

The fuel/air mixture is subsequently discharged into the combustion zone 12 of the chamber through the apertures 78. The serpentine geometry of the primary tubes 18 increases the mixing time of the fuel and air mixture while the tangential discharge imparts a circumferential swirl to the fuel/air mixture discharged therefrom. This swirling mixture is ignited in the combustion zone by the ignitor 34.

As the power level of the engine is increased, additional gaseous fuel is flowed through the supply means 62 to the manifolds 50 of the secondary tube 20. The gaseous fuel is radially injected into the flow path through the gas orifices 52 with sufficient momentum to be distributed across the flow path of the secondary mixing tubes 20. The combustor air enters the venturi premixer 40 substantially perpendicular to the gas jets so that the gas obtains maximum penetration for a given momentum. The gaseous fuel in the secondary tube 20 mixes with air flowing therethrough at a ratio which is approximately fifty to seventy-five percent (50–75%) of the stoichiometric ratio for the gaseous fuel employed. The fuel/air mixture is subsequently directed across the exit swirl vanes 72. The vanes impart a circumferential swirl to the mixture and in combination with the swirling fuel/air mixture from the primary tubes 18 cause a strong centrifugal force field to develop within the combustion zone.

Igniting and burning the primary fuel/air mixture substantially reduces the density of the gases in the radially outward portion of the combustion zone. Accordingly, the fuel/air mixture from the secondary tube is centrifuged outwardly into these hot, less dense gases. The hot gases raise the temperature of the secondary fuel/air mixture above the auto ignition point causing ignition of the secondary mixture. The forced mixing of the secondary fuel/air mixture into the combusting, primary, fuel/air mixture causes very rapid burning of the available fuel. Consequently, the time exposure of nitrogen and oxygen bearing gases to the high combustion temperature may be curtailed after short duration by the injection of temperature modifying dilution air through the holes 32.

It is the approach of the present invention that the combustor be operated at a lean fuel/air ratio for liquid fuel as well as for the gaseous fuel, that is in an oxygen rich environment in which the combustion temperature is substantially below the stoichiometric temperature. A fuel/air ratio not exceeding seventy-five percent (75%) of stoichiometric values adequately limit the production of nitrous oxides. Collaterally, excess oxygen assures complete combustion of the fuel and resultant low carbon monoxide emissions.

To maintain low fuel/air ratios, staged combustion is employed. Throughout the operating range of the engine, the fuel/air ratios in both the primary tubes and the secondary tubes are closely controlled.

The primary advantage of the present invention is that a gas turbine engine can operate on either liquid fuel or gaseous fuel while maintaining low nitrous oxide emissions.

Another advantage of the present invention is that the configuration for gaseous fuel injection can be modified easily to compensate for differences in operating conditions of customers. Natural gas at each different customer site has different temperature and pressure. To compensate for these variations in natural gas, each gas turbine engine must be customized to a specific site. The present invention allows for easy modification by changing the size of orifices.

Although the invention has been shown and described with respect to preferred embodiments thereof, it should be understood by those skilled in the art that various changes and omissions in the form and detail thereof may be made therein without departing from the spirit and scope of the invention. For example, the inclusion of the manifold is not as critical for the primary tubes as it is for the secondary tubes. The serpentine shape of the primary tubes promotes mixing of air and fuel, thereby resulting in a substantially uniform fuel/air mixture at the downstream end of the primary tubes. The secondary tube, however, does require an airblast nozzle for liquid fuel and the manifold for gaseous fuel.

We claim:

1. A combustor having a combustion zone including a central portion and a radially outward portion, and having a fuel/air mixing zone upstream of the combustion zone, said combustor having a plurality of primary fuel/air mixing tubes oriented to discharge a mixture of fuel and air circumferentially into said radially outward portion of the combustor, said combustor having a secondary fuel/air mixing tube having means for swirling a fuel/air mixture circumferentially into said central portion of the combustor, said combustor having means for igniting the primary fuel/air mixture so as to cause the swirling, secondary fuel/air mixture to be centrifuged outwardly into the burning primary fuel/air mixture, said combustor characterized by:

an airblast liquid fuel injector centrally mounted at an upstream end of said secondary fuel/air mixing tube for injecting liquid fuel into said secondary fuel/air mixing tube; and a manifold disposed radially outward from a mixing tube wall at said upstream end of said secondary fuel/air mixing tube, said manifold having a plurality of orifices formed within said mixing tube wall for injecting said gaseous fuel into said secondary fuel/air mixing tube.

2. The combustor according to claim 1 further characterized by said orifices being formed in a substantially perpendicular relationship to said mixing tube wall.

3. A combustor having a combustion zone including a central portion and a radially outward portion, and having a fuel/air mixing zone upstream of the combustion zone, said combustor having a plurality of primary fuel/air mixing tubes oriented to discharge a mixture of fuel and air circumferentially into said radially outward portion of the combustor, said combustor having a secondary fuel/air mixing tube having means for swirling a fuel/air mixture circumferentially into said central portion of the combustor, said combustor having means for igniting the primary fuel/air mixture so as to cause the swirling, secondary fuel/air mixture to be centrifuged outwardly into the burning primary fuel/air mixture, said combustor characterized by:

an airblast liquid fuel injector centrally mounted at an upstream end of each said fuel/air mixing tube for injecting liquid fuel into each said fuel/air mixing tube; and a manifold disposed radially outward from a mixing tube wall at said upstream end of each said fuel/air mixing tube, said manifold having a plurality of orifices formed within said mixing tube wall for injecting said gaseous fuel into each said fuel/air mixing tube.

4. The combustor according to claim 3 further characterized by said orifices being formed in a substantially perpendicular relationship to said mixing tube wall.

5. A combustor structure having a combustion zone including a central portion and a radially outward portion encased by a cylindrical body, and having a fuel and air mixing zone upstream thereof which includes a secondary fuel/air mixing tube surrounded by a plurality of pilot fuel and air mixing tubes wherein said secondary tube includes means for circumferentially swirling effluent dischargeable therefrom into the central portion of the combustion zone and wherein said pilot tubes are so oriented as to cause effluent dischargeable therefrom to swirl circumferentially about the radially outward portion of the combustor, said combustor characterized by:

an airblast liquid fuel injector centrally mounted at an upstream end of said secondary fuel/air mixing tube for injecting liquid fuel into said secondary fuel/air mixing tube; and a manifold disposed radially outward from a mixing tube wall at said upstream end of said secondary fuel/air mixing tube, said manifold having a plurality of orifices formed within said mixing tube wall for injecting said gaseous fuel into said secondary fuel/air mixing tube.

* * * * *